US010511117B2

(12) United States Patent
Kida et al.

(10) Patent No.: US 10,511,117 B2
(45) Date of Patent: Dec. 17, 2019

(54) CONNECTOR

(71) Applicant: Sumitomo Wiring Systems, Ltd., Yokkaichi, Mie (JP)

(72) Inventors: Shinjiro Kida, Mie (JP); Yujiro Imai, Mie (JP); Yuma Mamiya, Mie (JP); Masami Kawamoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/262,212

(22) Filed: Jan. 30, 2019

(65) Prior Publication Data

US 2019/0252817 A1 Aug. 15, 2019

(30) Foreign Application Priority Data

Feb. 15, 2018 (JP) ..... 2018-024607

(51) Int. Cl.
*H01R 13/627* (2006.01)
*H01R 13/506* (2006.01)
*H01R 13/422* (2006.01)

(52) U.S. Cl.
CPC ..... *H01R 13/506* (2013.01); *H01R 13/6272* (2013.01); *H01R 13/4223* (2013.01)

(58) Field of Classification Search
CPC ..... H01R 13/506; H01R 13/6272; H01R 13/4223
USPC ..... 439/357
See application file for complete search history.

(56) References Cited

U.S. PATENT DOCUMENTS 4,979,910 A * 12/1990 Revil ..... H01R 13/6272 439/357
5,015,199 A * 5/1991 Hirano ..... H01R 13/6272 439/353
5,021,003 A * 6/1991 Ohtaka ..... H01R 13/6272 439/357
5,338,219 A * 8/1994 Hiramoto ..... H01R 13/6272 439/350
5,554,044 A * 9/1996 Nishide ..... H01R 13/6272 439/352
5,711,684 A * 1/1998 Inoue ..... H01R 13/6272 439/354

(Continued)

FOREIGN PATENT DOCUMENTS

JP 2016-178076 10/2016

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A female connector (F) includes a housing (10) to fit into a receptacle (81) of a male connector (M), and a front retainer (50) to mount to a front part of the housing (10). The housing (10) includes a terminal accommodating portion (12) configured to accommodate female terminal fittings (11) and butting portions (24) in the form of flat plates extending forward from an outer periphery of the terminal accommodating portion (12) and configured to butt against a back surface of the receptacle 81 when the housing (10) is fit into the receptacle (81). The front retainer (50) includes a cover (51) configured to cover a front of the terminal accommodating portion (12) by being disposed along inner side surfaces of the butting portions (24). A formation range of the butting portions (24) is smaller than that of the cover (51) in a length direction of the butting portions (24).

7 Claims, 13 Drawing Sheets

(56) References Cited

U.S. PATENT DOCUMENTS 5,743,761 A * 4/1998 Kawase ..... B29C 45/006 439/595
5,775,953 A * 7/1998 Yamanashi ..... H01R 13/6273 439/357
5,823,807 A * 10/1998 Yamasaki ..... H01R 13/62916 439/157
5,876,230 A * 3/1999 Nishide ..... H01R 13/6272 439/352
5,911,935 A * 6/1999 Kawase ..... B29C 45/006 264/238
6,024,498 A * 2/2000 Carlisle ..... G02B 6/3869 385/55
6,115,915 A * 9/2000 Kawase ..... B29C 45/006 29/881
6,123,574 A * 9/2000 Matsuda ..... H01R 13/4223 439/488
6,217,365 B1 * 4/2001 Shinozaki ..... H01R 13/6272 439/358
6,332,800 B2 * 12/2001 Kodama ..... H01R 13/6273 439/357
6,383,011 B2 * 5/2002 Chen ..... H01R 13/6271 439/357
6,514,099 B2 * 2/2003 Endo ..... H01R 13/641 439/357
6,547,594 B2 * 4/2003 Ichio ..... H01R 13/4361 439/595
6,749,461 B2 * 6/2004 Ishikawa ..... H01R 13/4223 439/595
6,939,163 B2 * 9/2005 Fujita ..... H01R 13/4223 439/374
7,214,080 B2 * 5/2007 Ichio ..... H01R 13/6272 439/246
7,252,530 B2 * 8/2007 Shamoto ..... H01R 13/641 439/352
7,264,505 B2 * 9/2007 Miyakawa ..... H01R 13/4364 439/595
7,275,951 B2 * 10/2007 Shigeta ..... H01R 13/6271 439/352
7,347,710 B2 * 3/2008 Ohtaka ..... H01R 13/518 439/352
7,371,102 B2 * 5/2008 Sakamoto ..... H01R 13/6275 439/352
7,399,195 B2 * 7/2008 Kim ..... H01R 13/641 439/352
7,632,130 B2 * 12/2009 Sami ..... H01R 13/6395 439/352
7,753,713 B2 * 7/2010 Neale, III ..... H01R 13/64 439/357
7,828,585 B2 * 11/2010 Kurimoto ..... H01R 13/02 439/357
8,002,570 B2 * 8/2011 Matsumura ..... H01R 13/631 439/141
8,083,535 B2 * 12/2011 Chang ..... H01R 13/6397 439/357
8,137,123 B2 * 3/2012 Sakamoto ..... H01R 13/4361 439/345
8,602,808 B2 * 12/2013 Ashour ..... H01R 13/506 439/357
8,628,252 B2 * 1/2014 Matsumoto ..... G02B 6/3879 385/56
8,834,193 B2 * 9/2014 Li ..... H01R 13/6275 439/345
9,017,108 B2 * 4/2015 Suemitsu ..... H01R 13/4223 439/595
9,228,605 B2 * 1/2016 Takemura ..... H01R 9/18
9,972,936 B2 * 5/2018 Matsumoto ..... H01R 13/6272
9,972,939 B2 * 5/2018 Sekino ..... H01R 13/639
9,979,123 B2 * 5/2018 Sekino ..... H01R 13/4368
10,236,608 B2 * 3/2019 Nagata ..... H01R 12/716
10,243,288 B2 * 3/2019 Matsuzawa ..... H01R 12/91
2018/0076576 A1 3/2018 Ito et al.

* cited by examiner

CONNECTOR

BACKGROUND

Field of the Invention

The invention relates to a connector and a connector device.

Related Art

Japanese Unexamined Patent Publication No. 2016-178076 discloses a connector with a housing to be fit into a receptacle of a mating connector and a front member for covering the front end of the housing. The housing includes a peripheral wall surrounding the outer periphery of the front member. When the housing is fit into the receptacle of the mating connector, a butting portion constituting a front part of the peripheral wall butts against the back surface of the receptacle to position the connector in a connecting direction. Further, one surface of the peripheral wall is eliminated for miniaturization.

However, if at least one surface of the peripheral wall is eliminated, a clearance between the peripheral wall and the front member in a front view is open in a direction perpendicular to the connecting direction. Thus, the receptacle of the mating connector may be fit into that clearance at the time of connecting the connector. The receptacle that is fit into the clearance may concentrate stress on the butting portion of the peripheral wall to break the butting portion.

The invention was completed on the basis of the above conventional situation and aims to provide a connector capable of preventing the breakage of a butting portion while realizing the miniaturization of the connector.

SUMMARY

The invention is directed to a connector with a housing to be fit into a receptacle of a mating connector, and a front member to be mounted to a front part of the housing. The housing includes a terminal accommodating portion configured to accommodate terminal fittings and a flat plate-shaped butting portion extends forward from an outer periphery of the terminal accommodating portion. The butting portion is configured to butt against a back end surface of the receptacle when the housing is fit into the receptacle. The front member includes a cover configured to cover a front end of the terminal accommodating portion by being disposed along an inner side surface of the butting portion. A formation range of the butting portion in a length direction is smaller than that of the cover of the butting portion.

The invention is directed to a connector device with a connector, and a mating connector to be connected to the connector. The connector includes a housing to be fit into a receptacle of the mating connector. A front member is to be mounted to a front part of the housing. The connector also includes a lock. The housing includes a terminal accommodating portion configured to accommodate terminal fittings and a butting portion. The butting portion is substantially in the form of a flat plate extending forward from an outer peripheral edge of the terminal accommodating portion and is configured to butt against a back surface of the receptacle when the housing is fit into the receptacle. The front member includes a cover configured to cover a front end of the terminal accommodating portion by being disposed along an inner side surface of the butting portion. A formation range of the butting portion is smaller than that of the cover in a length direction of the butting portion in a front view. The mating connector includes a lock receiving portion to be locked to the lock. An outer rib of the connector guides the lock in a direction to be locked to the lock receiving portion of the mating connector.

Since the formation range of the butting portion is smaller than that of the cover in the length direction of the butting portion in a front view, warping during the molding of the butting portion can be suppressed to suppress the expansion of a clearance between both ends of the butting portion and the cover. Thus, the receptacle is less likely to enter the clearance between the butting portion and the cover when the connector is connected to the male connector. Accordingly, stress is less likely to concentrate on the butting portion and to break the butting portion.

Further, the outer rib of the connector can be utilized as a guide for guiding the connector in the direction to be locked to the mating connector.

The housing may include an outer rib projecting from the butting portion to a side opposite to the cover and extending in a front-rear direction. The outer rib suppresses warping during the molding of the butting portion. Therefore, the expansion of opening parts on both ends of the clearance between the end parts of the butting portion and the cover in a front view can be suppressed more reliably.

A front end of the outer rib may be aligned with that of the butting portion in a front-rear direction. If the butting portion is thin, a testing tool is not stabilized by being inclined in a thickness direction of the butting portion or slipping even if it is attempted to measure a position in the front-rear direction by pressing the testing tool against a front end of the butting portion. However, according to the invention, the testing tool can be pressed reliably against the front end of the butting portion by being pressed against an intersecting part of the butting portion and the outer rib. Accordingly, the position of the front end of the butting portion in the front-rear direction can be grasped precisely, and a forward projecting dimension of the front member from the front end of the butting portion can be measured.

The front member may include intrusion preventing portions projecting from the cover to close both sides of a clearance formed between the cover and the butting portion in a front view. Thus, entrances to the clearance between the butting portion and the cover are closed by the intrusion preventing portions. Accordingly, the receptacle cannot enter into the clearance. Thus, stress will not concentrate on the butting portion of the housing and the butting portion will not be broken by the entrance of the receptacle into the clearance.

The housing may include an inner rib projecting from the butting portion toward the cover and extending in the front-rear direction. Thus, the butting portion will not warp during molding, and the expansion of the opening parts on the both ends of the clearance between the end parts of the butting portion and the cover in a front view can be suppressed reliably.

The lock of the connector may include a cantilevered resilient locking piece using the outer rib as a supporting point. Thus, the connector can be simplified in shape as compared to the case where a support of the lock and the outer rib are separated. Thus, resin satisfactorily spreads and a molding failure is unlikely to occur during resin molding.

DETAILED DESCRIPTION

An embodiment of the invention is described with reference to FIGS. 1 to 13. Note that, in the following description, a connecting direction at the time of connection to a male connector M is defined as a forward direction concerning a front-rear direction of a female connector F, and a connecting direction at the time of connection to the female connector F is defined as a forward direction concerning a front-rear direction of the male connector M. Upper and lower sides in FIGS. 1 to 4, 6, 7 and 9 are defined as upper and lower sides concerning a vertical direction. A direction perpendicular to the vertical direction and the front-rear direction is defined as a lateral direction.

<Connector Device>

Figure 1:
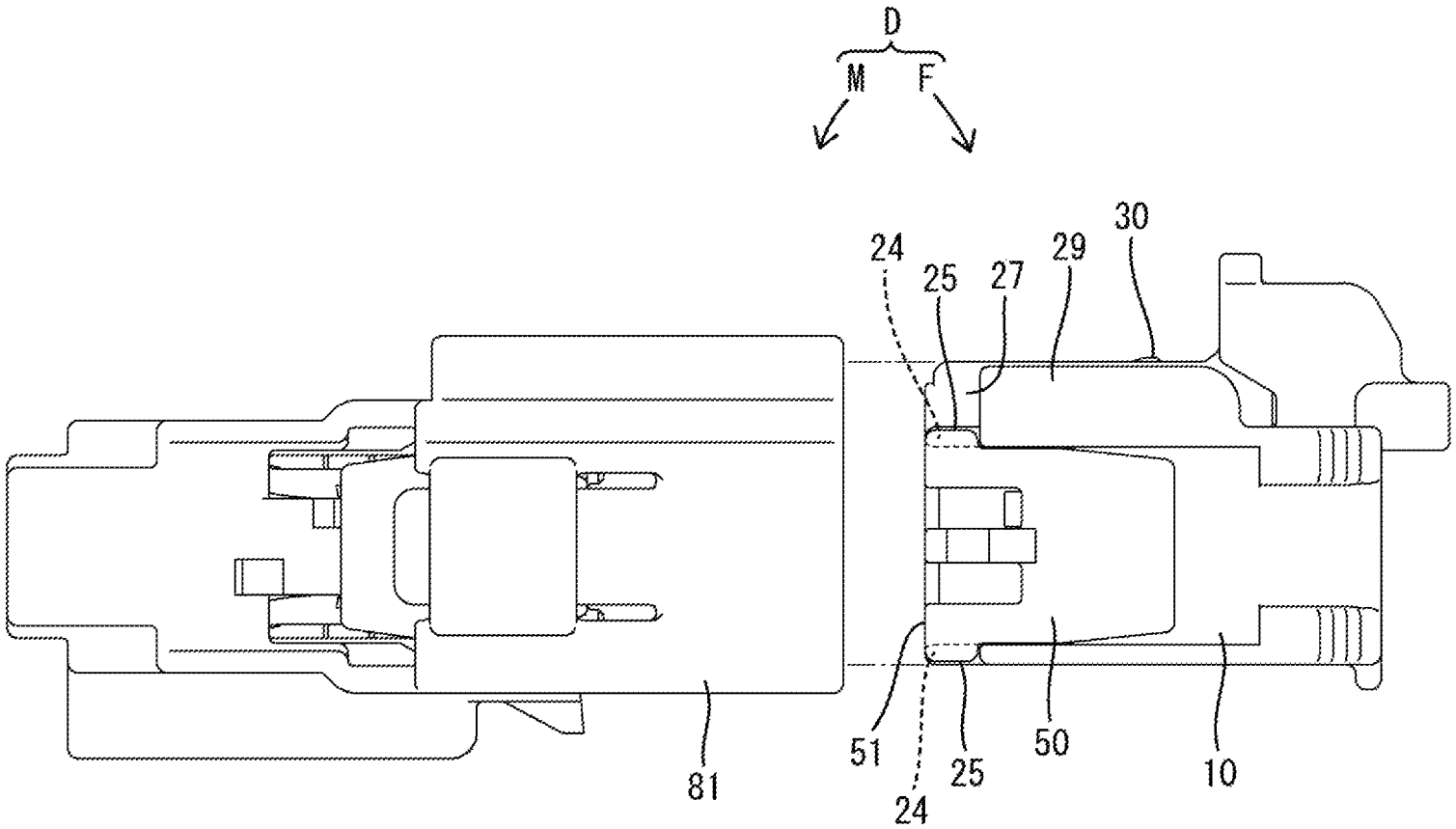
FIG. 1 is a side view of a connector device of one embodiment before connection.
Figure 2:
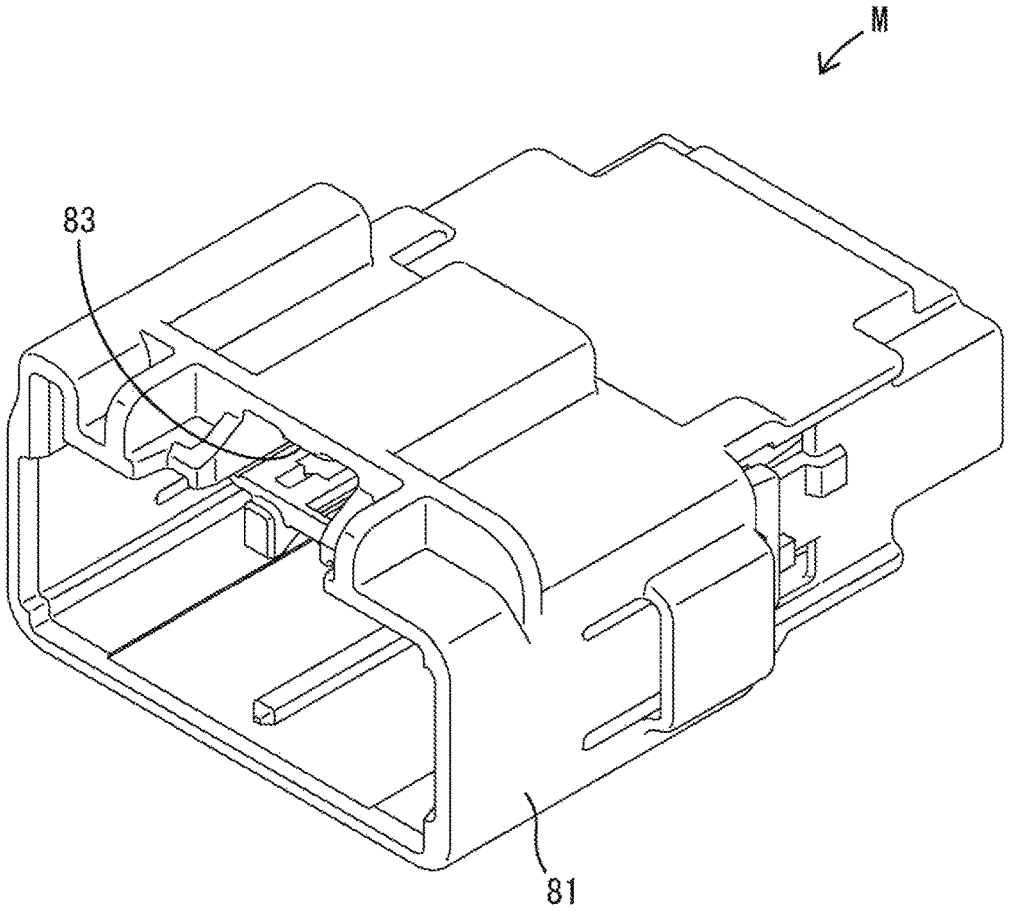
FIG. 2 is a perspective view of a male connector.
Figure 3:
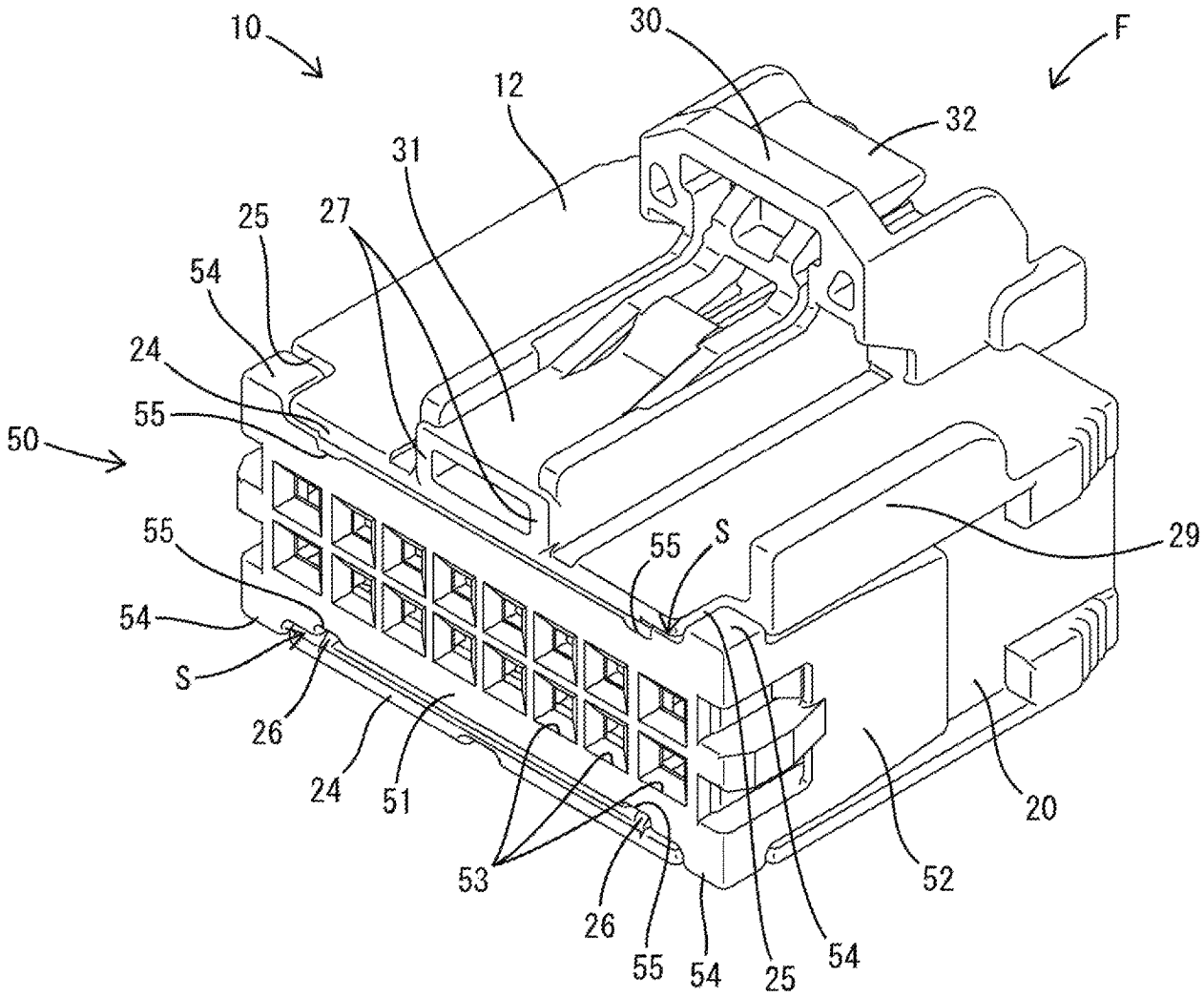
FIG. 3 is a perspective view of a female connector.
Figure 4:
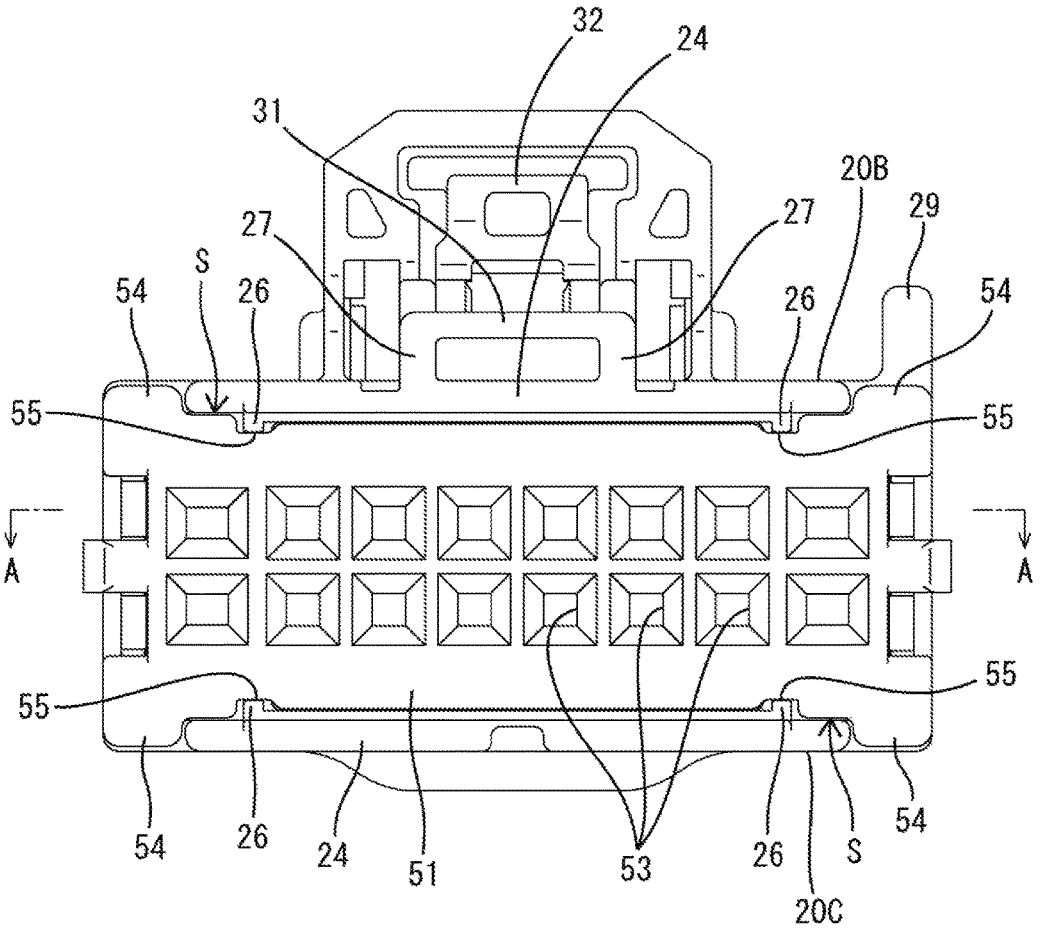
FIG. 4 is a front view of the female connector.
Figure 5:
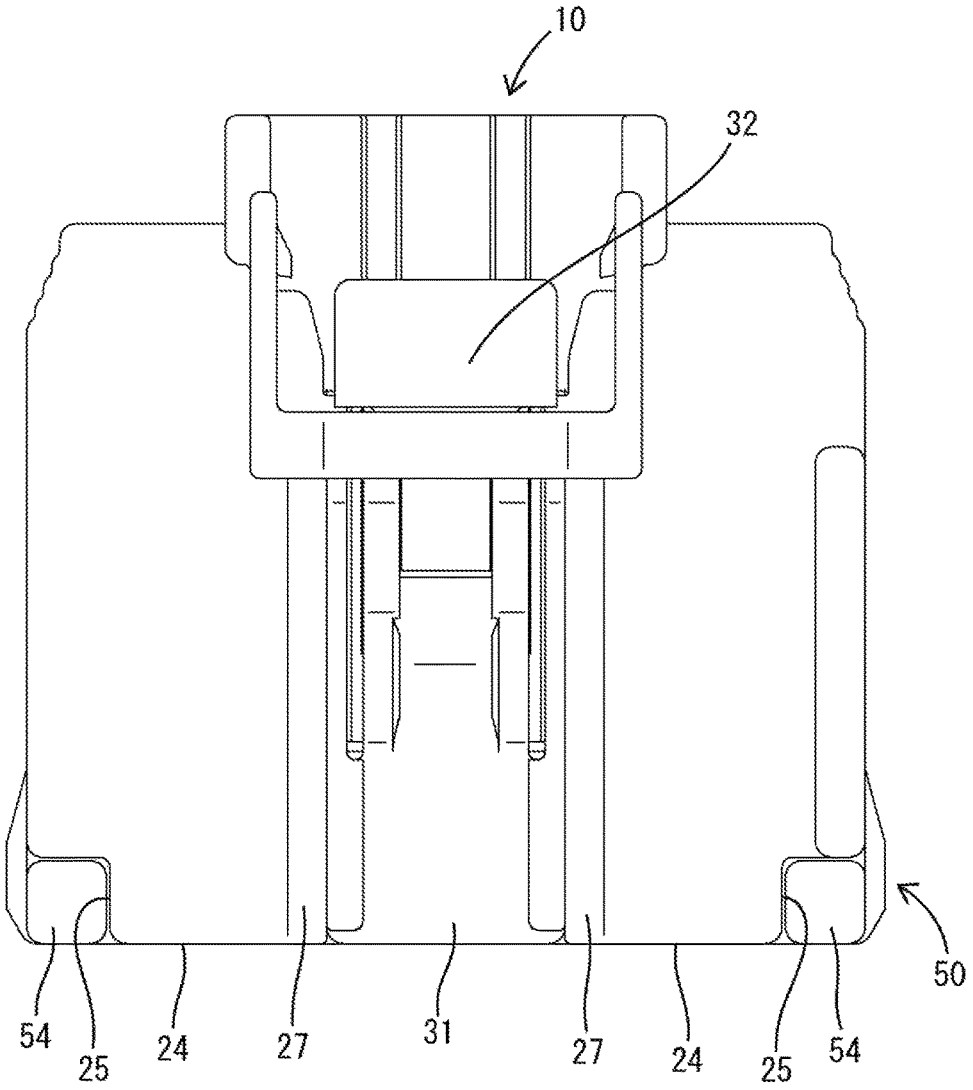
FIG. 5 is a plan view of the female connector.
Figure 6:
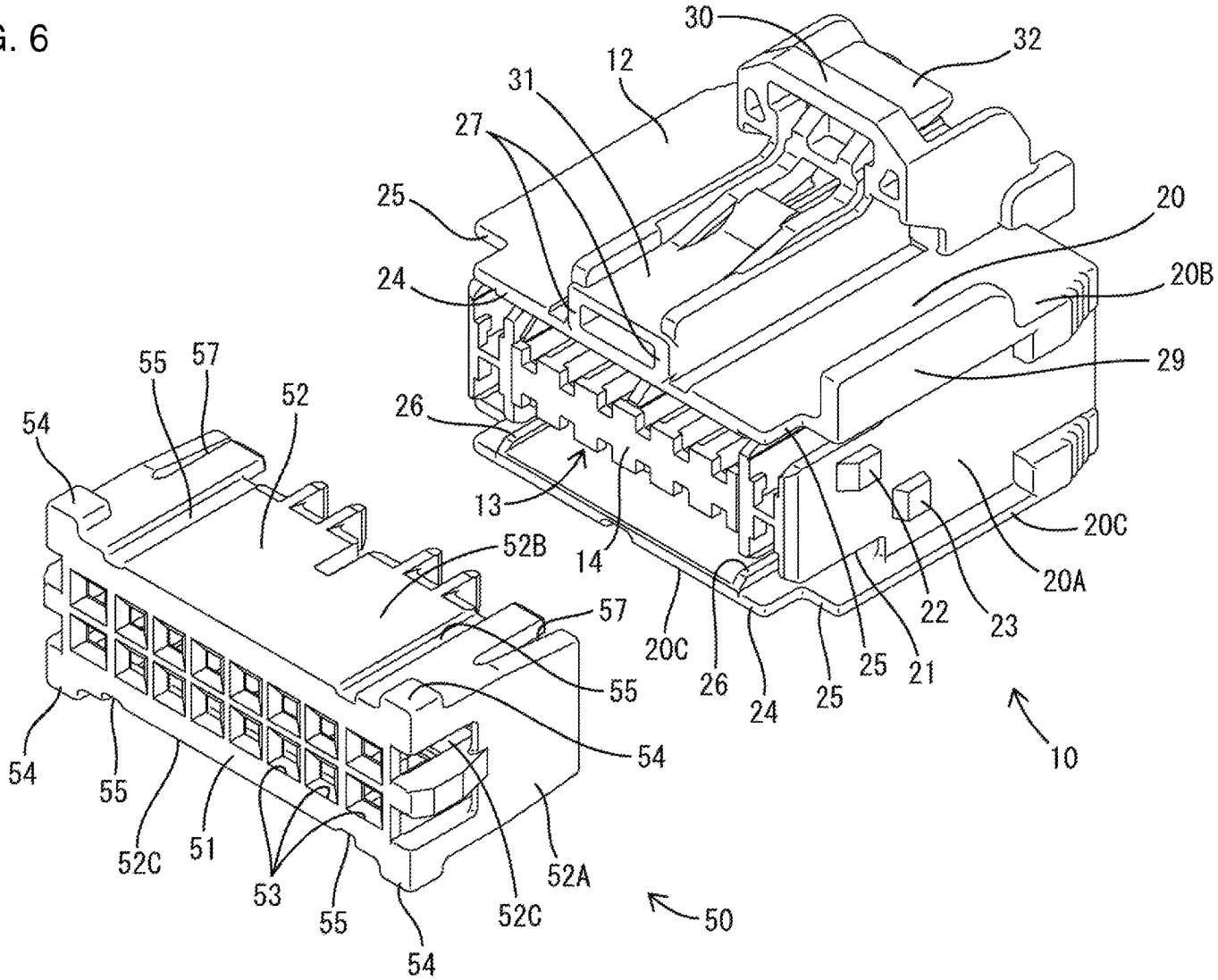
FIG. 6 is an exploded perspective view of the female connector.
Figure 7:
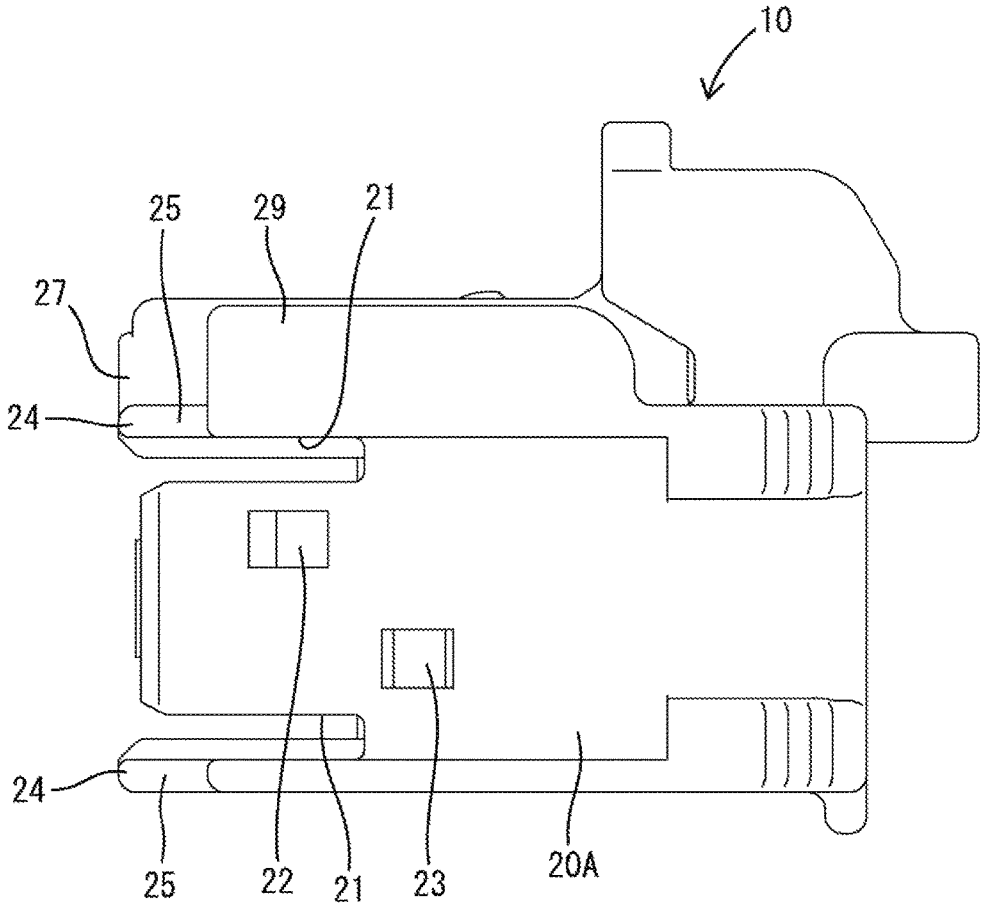
FIG. 7 is a side view of a housing.
Figure 8:
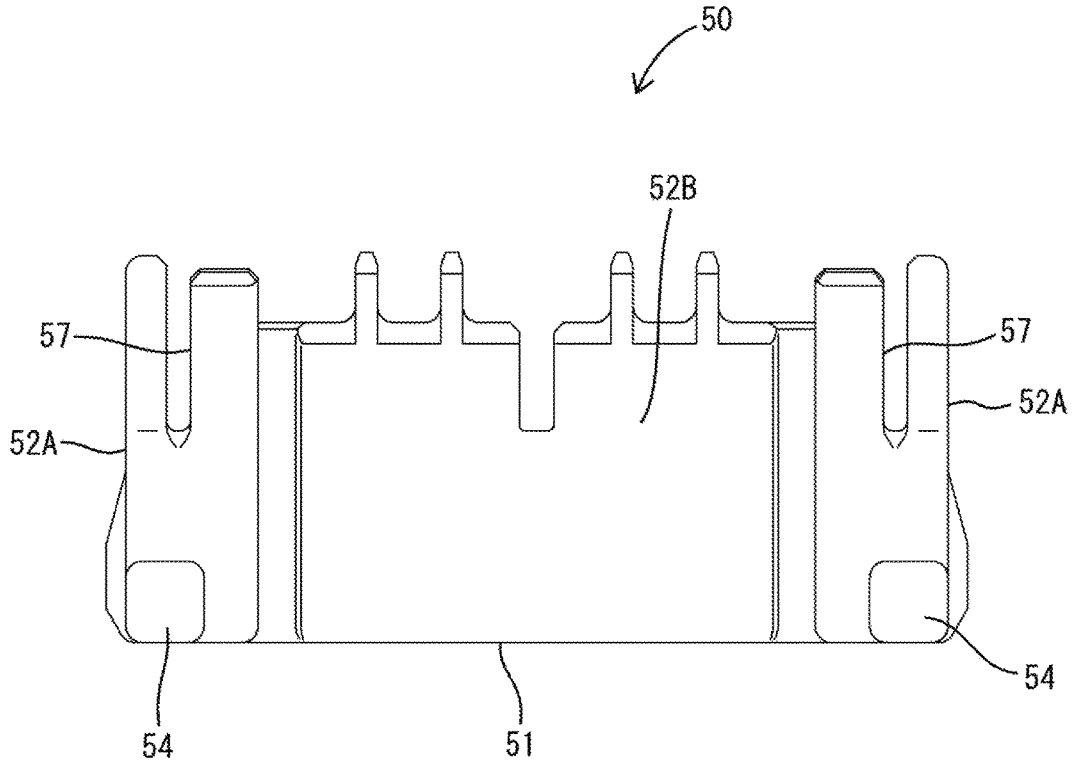
FIG. 8 is a plan view of a front retainer.
Figure 9:
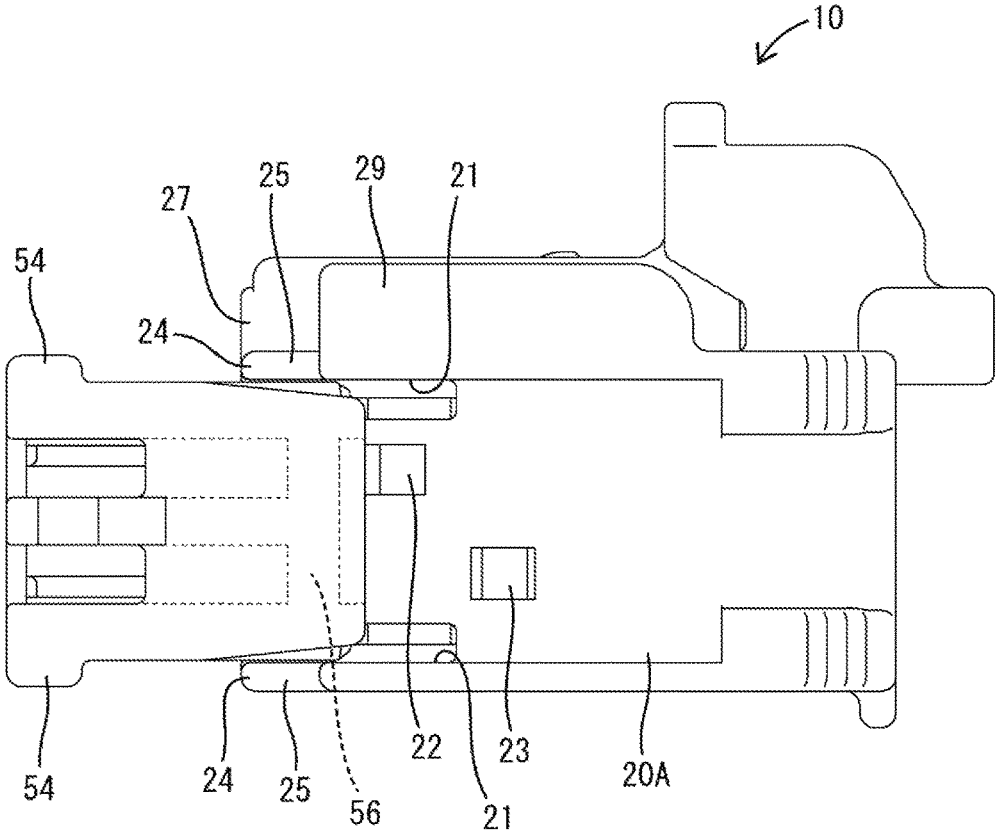
FIG. 9 is a side view showing a state before the front retainer is locked to the housing.

A connector device D of this embodiment includes the female connector F equivalent to a "connector" of the invention and the male connector M equivalent to a "mating connector" of the invention as shown in FIG. 1. The male connector M is made of synthetic resin and, as shown in FIG. 2, is formed with a forwardly open receptacle 81. The female connector F is fit into this receptacle 81. An opening part of the receptacle 81 is bilaterally asymmetrically shaped and non-corresponding connectors cannot be inserted. A lock receiving portion 83 is formed on an outer side surface (upper surface in this embodiment) of the receptacle 81. The female connector F is formed with a lock arm 30 to be locked to this lock receiving portion 83 (see FIG. 3). Note that the lock arm 30 is equivalent to a "lock" of the present invention.

The female connector F includes, as shown in FIGS. 3 to 6, a housing 10 made of synthetic resin and a front retainer 50 made of synthetic resin and to be mounted into a front part of the housing 10. Note that the front retainer 50 is equivalent to a "front member" of the present invention.

As shown in FIGS. 3 to 7, the housing 10 includes a terminal accommodating portion 12 for accommodating female terminal fittings 11. The terminal accommodating portion 12 has a substantially rectangular shape long in one direction (lateral direction in this embodiment) in a front view. The terminal accommodating portion 12 includes a terminal holding portion 13 for holding the female terminal fittings 11 arranged in the lateral direction and a peripheral wall 20 continuous with the terminal holding portion 13 and shaped to surround upper, lower, left and right sides of the terminal holding portion 13. The terminal holding portion 13 includes locking lances (not shown) for preventing rearward withdrawal of the female terminal fittings 11 by locking the female terminal fittings 11 inserted from behind. Further, the terminal holding portion 13 constitutes a front part of the terminal accommodating portion 12 and includes a restricting portion 14 for restricting forward movements of the female terminal fittings 11 locked by the locking lances.

The peripheral wall 20 includes left and right side plates 20A, an upper plate 20B and a lower plate 20C. The left and right side plates 20A are at positions retracted laterally inward of left and right side end edges of the upper and lower plates 20B, 20C. Upper and lower end parts of front parts of the left and right side plates 20A are cut off Thus, housing-side slits 21 open forward and to the left and right are formed between the front parts of the left and right side plates 20A and the upper and lower plates 20B, 20C. Central and rear parts of the left and right side plates 20A are continuous with the upper and lower plate portions 20B, 20C. Further, an area connecting the housing-side slits 21 on both left and right sides in a horizontal direction is open forward and both leftward and rightward, and serves as a space into which a part of the front retainer 50 can be accommodated from the front. The front end of the upper plate 20B is aligned with that of the lower plate 20C in the front-rear direction. The front ends of the left and right side plates 20A are disposed slightly before those of the upper and lower plates 20B, 20C. The front ends of the left and right side plates 20A substantially align with that of the terminal holding portion 13 in the front-rear direction. Specifically, the front ends of the upper and lower plates 20B, 20C are slightly behind that of the terminal holding portion 13.

The peripheral wall 20 includes temporary lock receiving portions 22 and complete lock receiving portions 23 projecting out from outer side surfaces of the respective left and right side plates 20A. The complete lock receiving portion 23 is at a predetermined distance from the temporary lock receiving portion 22 and behind the temporary lock receiving portion 22. The temporary lock receiving portions 22 on both left and right sides are aligned in the front-rear direction while being shifted in the vertical direction. Similarly, the complete lock receiving portions 23 on left and right sides are aligned in the front-rear direction while being shifted in the vertical direction.

The housing 10 includes butting portions 24 in the form of flat plates extending forward from the front ends of the upper and lower plates 20B, 20C (peripheral wall 20) of the terminal accommodating portion 12. The butting portions 24 are flush with the upper and lower plates 20B, 20C. Left and right ends of the butting portions 24 are at positions retracted inward of both left and right ends of the upper and lower plates 20B, 20C. Specifically, a formation range of the butting portions 24 is smaller than that of the terminal accommodating portion 12 in a length direction (lateral direction in this embodiment) of the butting portions 24 in a front view.

The left and right side plates 20A are disposed laterally outward of both left and right ends of the butting portions 24. Specifically, the left and right side plates 20A are disposed between the both left and right end edges of the butting portions 24 and the left and right ends of the upper and lower plates 20A, 20B in a front view. The front ends of the left and right side plates 20A and that of the terminal holding portion 13 are disposed rearward of the front ends of the butting portions 24, and disposed forward of the rear ends of the butting portions 24 (front ends of the upper and lower plate portions 20B, 20C).

The housing-side slits 21 are laterally outward of the left and right end edges of the butting portions 24. Specifically, the housing-side slits 21 are between the left and right ends of the butting portions 24 and the left and right ends of the upper and lower plates 20B, 20C in a front view. The front ends of the housing-side slits 21 are at positions slightly behind the front ends of the butting portions 24 and in front of the rear ends of the butting portions 24 (front ends of the upper and lower plate portions 20B, 20C). The housing-side slits 21 extend to positions rearward of the rear ends of the butting portions 24.

The housing 10 is formed with cut portions 25 defined by both lateral end edges of the butting portions 24 and the front edges of both left and right end parts of the upper and lower plates 20B, 20C and cut into a substantially rectangular shape in a plan view.

Inner ribs 26 projecting in facing directions (inward, toward the space where the front retainer 50 is to be accommodated, toward the front retainer 50) from surfaces facing each other and extending in the front-rear direction are formed on the upper and lower butting portions 24 and front parts of the upper and lower plates 20B, 20C. One inner rib 26 is provided on each of both left and right end parts of the butting portions 24 and the upper and lower plates 20B, 20C. The front ends of the inner ribs 26 substantially align with those of the butting portions 24. A formation range of the aforementioned housing-side slits 21 in the front-rear direction is substantially the same as that of the inner ribs 26 in the front-rear direction.

The upper butting portion 24 and the upper plate 20B (housing 10) are formed with outer ribs 27 projecting out (up in this embodiment) from outer side surfaces (upper surfaces in this embodiment) and extending in the front-rear direction. The front ends of the outer ribs 27 are aligned with those of the butting portions 24. Further, the front ends of the outer ribs 27 are located slightly forward of those of the housing-side slits 21, and the outer ribs 27 extend to positions rearward of the rear ends of the housing-side slits 21. The outer ribs 27 are formed in a laterally central part. Two outer ribs 27 are disposed parallel to each other. Note that a predetermined number of (one in this embodiment) erroneous connection preventing rib(s) 29 extending parallel to the outer ribs 27 is/are formed on the surface of the housing 10 where the outer ribs 27 are provided.

The upper butting portion 24 and the upper plate 20B (housing 10) are formed with the lock arm 30. The lock arm 30 constitutes parts of the outer ribs 27, and includes a connecting portion 31 linking the outer ribs 27 to each other while being spaced apart from the butting portion 24 and a cantilevered resilient locking piece 32 configured to be resiliently displaced with the connecting portion 31 as a support. The front end of the connecting portion 31 is aligned with those of the butting portions 24 in the front-rear direction.

The front retainer 50 has substantially the same shape (rectangular shape) as the terminal accommodating portion 12 in a front view. The front retainer 50 includes a cover 51 in the form of a flat plate covering the front surface of the terminal accommodating portion 12 (terminal holding portion 13) and having a rectangular shape in a front view, and an extending portion 52 extending rearward from the outer periphery of the cover 51. The cover 51 is formed with insertion holes 53 to receive male terminal fittings (not shown) to be connected to the respective female terminal fittings 11. Intrusion preventing portions 54 projecting in the vertical direction are formed on four corners (both left and right end parts of both upper and lower end parts) of the cover 51 in a front view. The front surfaces of the intrusion preventing portions 54 are continuous and flush with the front surface of the cover 51. Both left and right outer side surfaces of the intrusion preventing portions 54 are continuous and flush with both outer side surfaces of the covers 51.

Grooves 55 are formed in the upper and lower end surfaces of the cover 51 and the extending portion 52 (front retainer 50) for receiving the inner ribs 26 of the housing 10. The extending portion 52 includes left and right side plates 52A, an upper plate 52B and a lower plate 52C. Locking ribs 56 to be locked to the temporary lock receiving portions 22 or complete lock receiving portions 23 of the housing 10 are formed on the inner surfaces of the left and right side plates 52A of the extending portion 52. A width of the locking rib 56 is equal to or slightly smaller than an interval between the temporary lock receiving portion 22 and the complete lock receiving portion 23. The extending portion 52 is formed with front-side slits 57 extending in the front-rear direction and open rearward at positions corresponding to the housing-side slits 21 in a front view (see FIG. 8).

<Assembling of Connector Device D>

Figure 10:
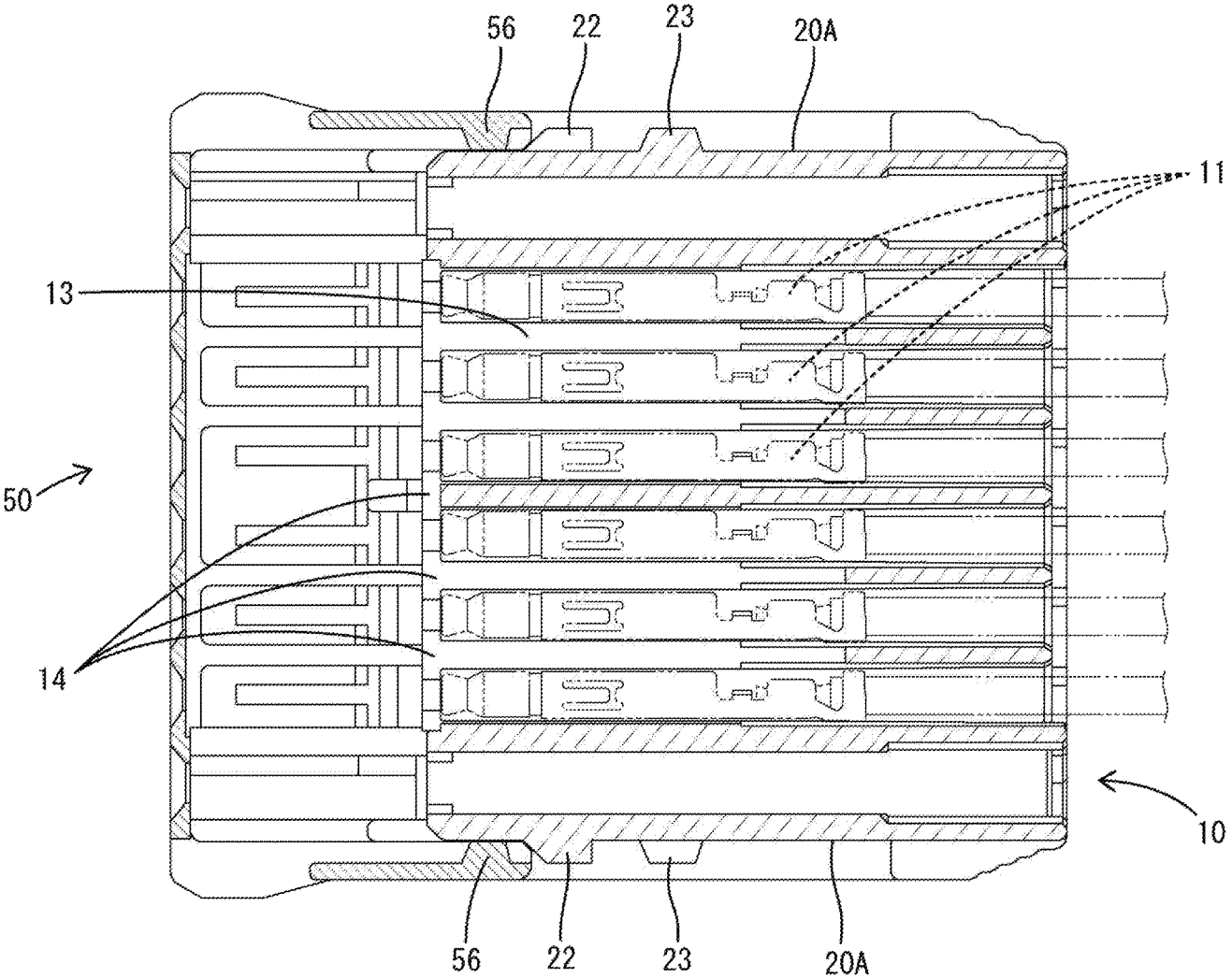
FIG. 10 is a section along A-A showing the state before the front retainer is locked to the housing.
Figure 11:
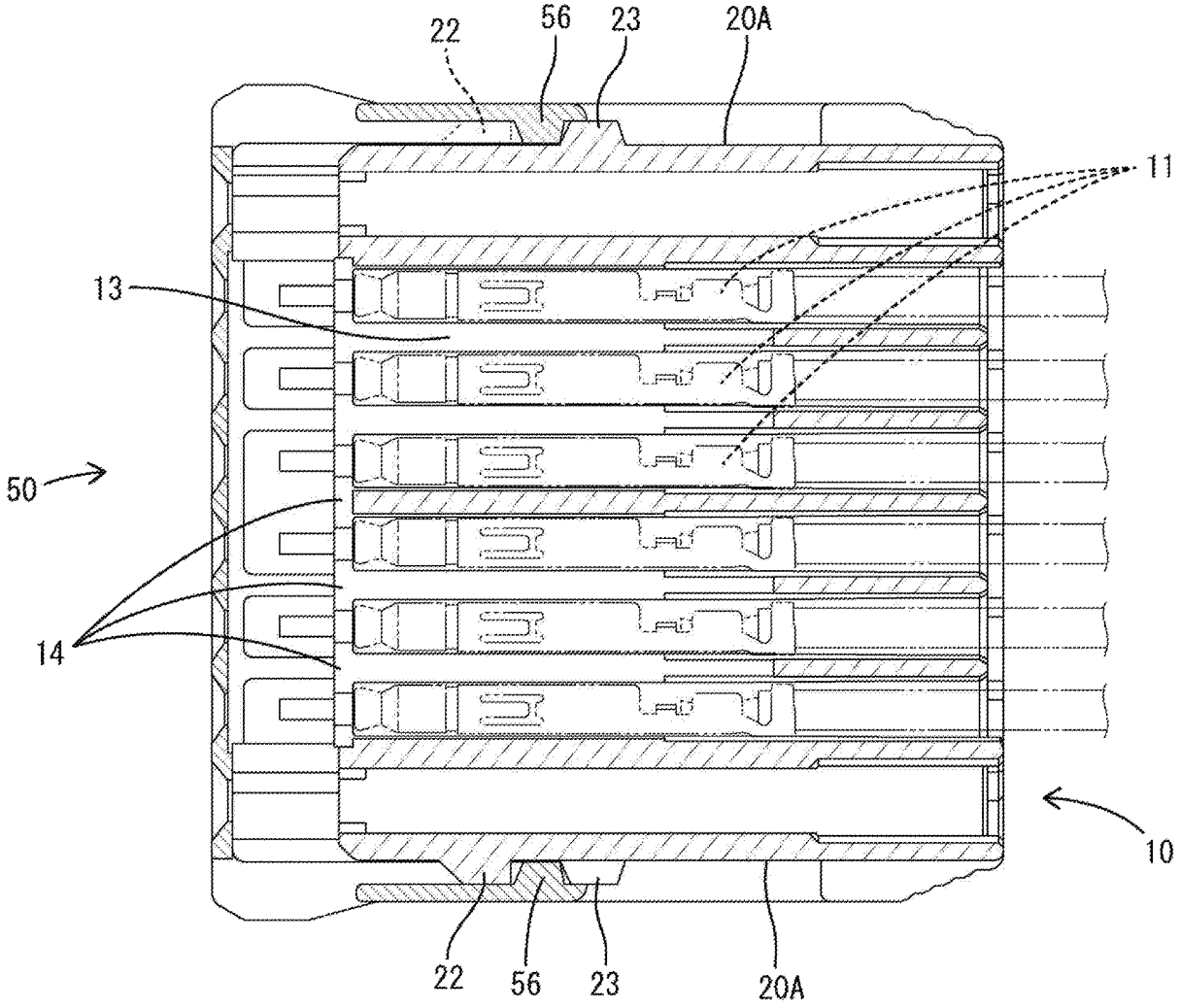
FIG. 11 is a section along A-A showing a state where the front retainer is temporarily locked to the housing.
Figure 12:
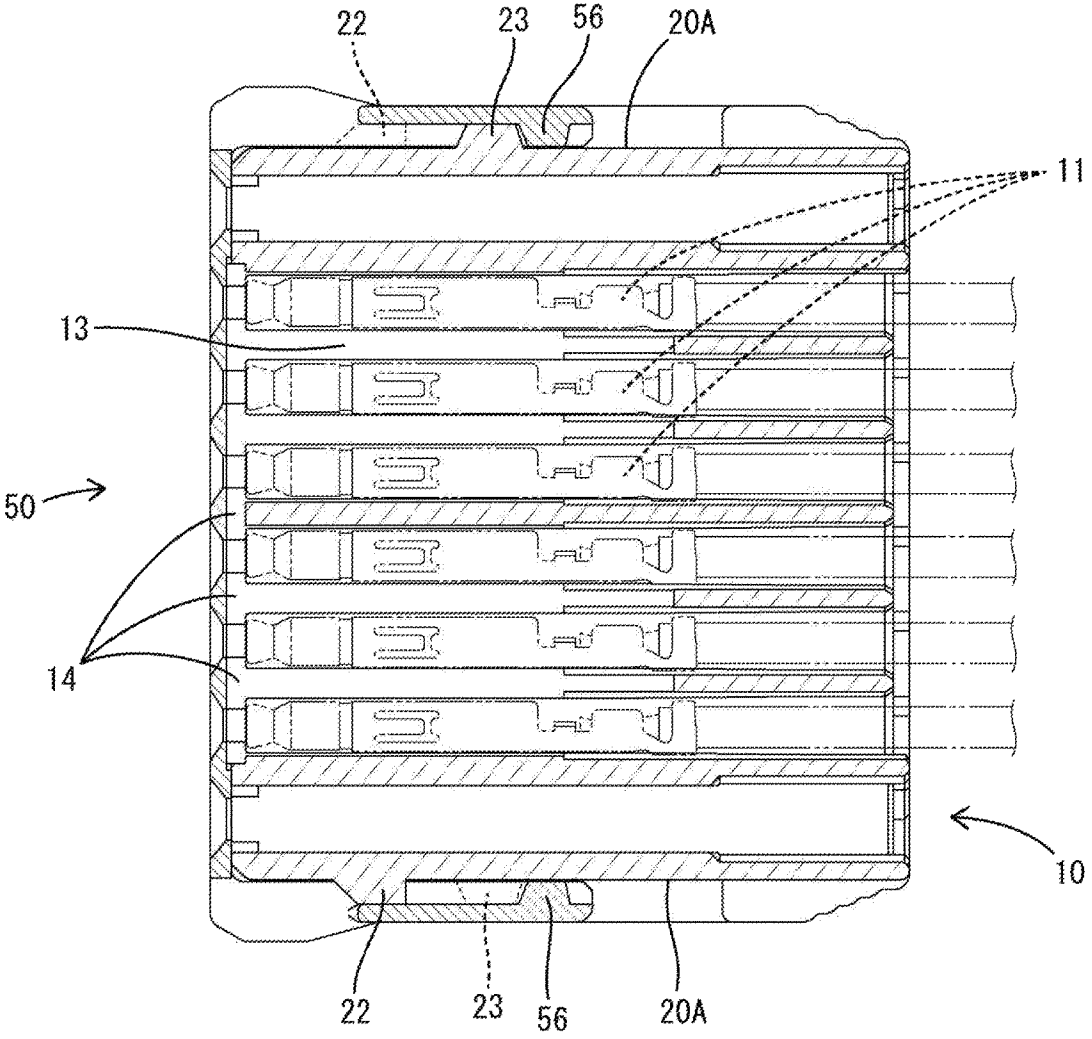
FIG. 12 is a section along A-A showing a state where the front retainer is completely locked to the housing.

In the assembling of the female connector F, the front retainer 50 is assembled with the housing 10 from front as shown in FIGS. 9 to 12. The front retainer 50 moves in an assembling direction along the inner surfaces of the upper and lower butting portions 24 (terminal accommodating portion 12) when being assembled with the housing 10. At this time, the grooves 55 of the front retainer 50 are fit to the inner ribs 26 and move in the assembling direction along the inner ribs 26. Further, the left and right side plates 52A of the extending portion 52 of the front retainer 50 move in the assembling direction along the outer side surfaces of the left and right side plates 20A of the housing 10, as shown in FIG. 10. When the front retainer 50 moves in the assembling direction, the front-side slits 57 are fit into the housing-side slits 21. Further, the locking ribs 56 move onto the temporary lock receiving portions 22 to be deflected outward and return to an initial shape after moving over the temporary lock receiving portions 22 to achieve a temporarily locked state (see FIG. 11). In the temporarily locked state, the locking ribs 56 are fit between the temporary lock receiving portions 22 and the complete lock receiving portions 23 and displacements of the locking ribs 56 in the front-rear direction are restricted by the temporary lock receiving portions 22 and the complete lock receiving portions 23. When the front retainer 50 further moves in the connecting direction, the locking ribs 56 move onto the complete lock receiving portions 23 to deflect out and return to an initial shape after moving over the complete lock receiving portions 23 to set a completely locked state (see FIG. 12).

Figure 13A:
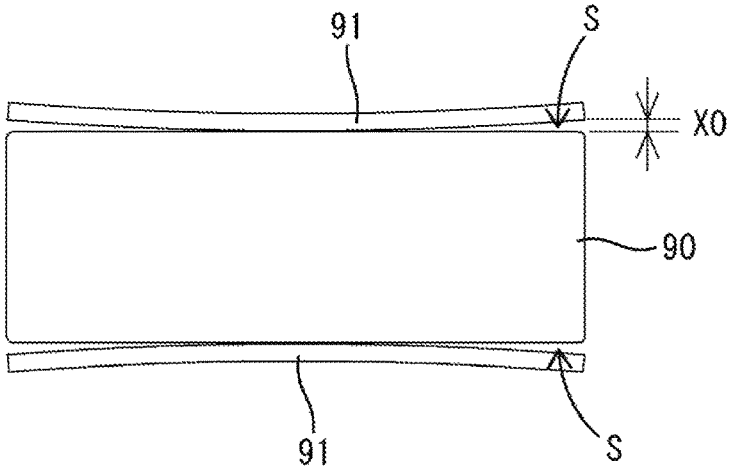
FIG. 13(A) is a view conceptually showing opening dimensions between both end parts of butting portions and a cover portion when a width of the butting portions is equal to that of the cover portion as a comparative example and FIG. 13(B) is a view conceptually showing opening dimensions between both end parts of butting portions and a cover portion when a width of the butting portions is smaller than that of the cover portion.
Figure 13B:
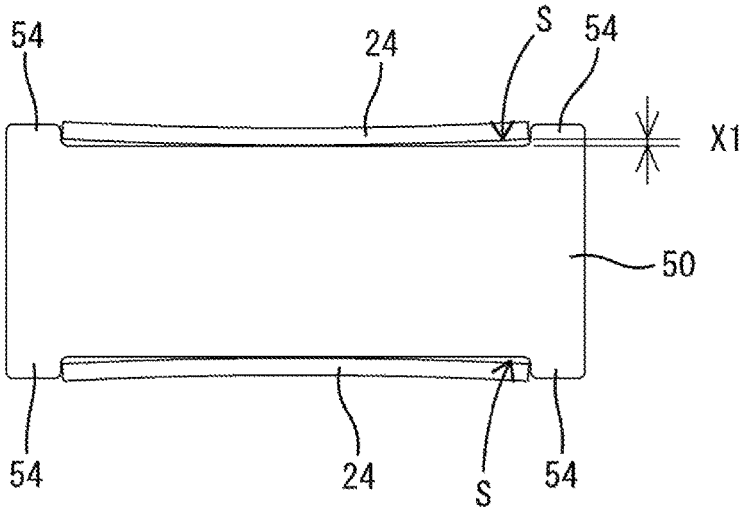

In the completely locked state, the cover 51 (front retainer 50) is disposed along the inner surfaces of the butting portions 24 and between the upper and lower plates 20B, 20C. Further, a formation range of the butting portions 24 is smaller than that (width) of the cover 51 in a length direction (lateral direction in this embodiment) of the butting portions 24 in a front view. This can suppress the expansion of openings of clearances S at both left and right ends formed between the both end parts of the butting portions 24 and the cover 51 in a front view due to the warping of the butting portions 24 during molding. Specifically, if a curvature of warp generated during the molding of the butting portions 24 is thought to be constant regardless of a plate width of the butting portions 24, the expansion of the opening dimension can be suppressed by making the plate width of the butting portions 24 smaller. For example, as in a comparative example shown in FIG. 13(A), an opening dimension is X0 if a formation range of butting portions 91 is equal to that of a cover 90 in a length direction of the butting portions 91 in a front view. In contrast, the opening dimension is X1 smaller than X0 as shown in FIG. 13(B) if the formation range of the butting portions 24 is smaller than that of the cover 51 in the length of the butting portions 24 in a front view.

In the completely locked state, the cover 51 protrudes farther out than the butting portions 24 in the length direction of the butting portions 24 in a front view. The intrusion preventing portions 54 project toward the butting portion 24 (upper and lower sides) from protruding parts of the cover 51 to close opening parts on both ends of the clearances S between the cover 51 and the butting portions 24 in a front view. Specifically, the intrusion preventing portions 54 are disposed on extensions of the clearances S in the length direction of the butting portions 24 in a front view and prevent the intrusion of the receptacle 81 of the male connector M into the clearances S in the length direction of the butting portion 24 in a front view. Further, the intrusion preventing portions 54 project to fill the cut portions 25 of the housing 10. Specifically, both left and right ends of upper and lower edge parts in the front part of the female connector F are constituted by the intrusion preventing portions 54 of the front retainer 50, and the butting portions 24 are disposed adjacent to and between the left and right intrusion preventing portions 54. The front ends of the intrusion preventing portions 54 are substantially aligned with those of the butting portions 24 in the front-rear direction. Projecting end surfaces of the intrusion preventing portions 54 are substantially flush with the vertically outer surfaces of the butting portions 24 (terminal accommodating portion 12). The projecting end surfaces (upper end surfaces, lower end surfaces) of the intrusion preventing portions 54 are not covered by the butting portions 24 and vertically exposed to outside. The rear surfaces of the intrusion preventing portions 54 rise along front end edges of both left and right end parts of the upper and lower plates 20B, 20C. Both left and right inner surfaces of the intrusion preventing portions 54 rise along both left and right end edges of the butting portions 24. The front end of the front retainer 50 is aligned with or behind those of the butting portions 24 in the front-rear direction.

The female connector F in the completely locked state is fit into the receptacle 81 of the male connector M. At this time, in the case of a connector like the comparative example shown in FIG. 13(A), both ends of the clearances S are open on left and right sides. Thus, the receptacle 81 may enter these opening parts. If the receptacle 81 enters the clearances S, stress may be concentrated on the butting portions 24 to break the butting portions 24.

In contrast, in the female connector F of this embodiment, the opening parts on both ends of the clearances S are closed by the intrusion preventing portions 54. Thus, the female connector F can be fit into the receptacle 81 without the receptacle 81 entering the opening parts on the both ends of the clearances S. When the intrusion preventing portions 54 of the female connector F are accommodated into the receptacle 81, the female connector F and the male connector M are arranged to face in front of each other with the intrusion preventing portions 54 kept accommodated in the receptacle 81. At this time, the outer side surfaces of the butting portions 24 are disposed to be substantially flush with the outer side surfaces of the intrusion preventing portions 54 or vertically outward (inward) of the outer side surfaces of the intrusion preventing portions 54. Accordingly, the receptacle 81 enters along the outer side surfaces of the butting portions 24 (along outer sides of the outer side surfaces of the butting portions 24). Thus, the receptacle 81 cannot enter into the clearances S between the butting portions 24 and the cover 51. The outer ribs 27 of the female connector F move along the lock receiving portion 83 of the male connector M when the female connector F is arranged to face the male connector M and is inserted into the receptacle 81. The lock arm 30 is pressed by the lock receiving portion 83 and deflects down when the female connector F is inserted in that state. The lock arm 30 returns to an initial shape and is locked to the lock receiving portion 83 when a locking claw of the lock arm 30 moves over the lock receiving portion 83. In this way, the female connector F is connected to the male connector M.

<Functions and Effects of Embodiment>

As described above, the female connector F of this embodiment includes the housing 10 to be fit into the receptacle 81 of the male connector M, and the front retainer 50 to be mounted into the front part of the housing 10. The housing 10 includes the terminal accommodating portion 12 to accommodate the female terminal fittings 11. The butting portions 24 in the form of substantially flat plates extend forward from the outer peripheral edge of the terminal accommodating portion 12 and are configured to butt against the back surface of the receptacle 81 when the housing 10 is fit into the receptacle 81. The front retainer 50 includes the cover 51 configured to cover the front end of the terminal accommodating portion 12 by being disposed along the inner surfaces of the butting portions 24. Additionally, the intrusion preventing portions 54 project from the cover 51 to close the opening parts on the end parts of the clearances S between the cover 51 and the butting portions 24 in a front view. In this way, entrances to the clearances S between the butting portions 24 and the cover 51 are closed by the intrusion preventing portions 54 to prevent the entrance of the receptacle 81 into the clearances S. Therefore, stress is not likely to concentrate on and break the butting portions 24 due to the entrance of the receptacle 81 into the clearances S.

The housing 10 includes the inner ribs 26 and the outer ribs 27 projecting in a thickness direction of the butting portions 24 from the butting portions 24 and extending in the front-rear direction. The ribs 26, 27 suppress warping of the butting portions 24 during molding. Thus, opening parts on both ends of the clearances S between the end parts of the butting portions 24 and the cover 51 are unlikely to expand, thereby preventing entry of the receptacle 81 into the clearances S between the butting portions 24 and the cover 51.

The front retainer 50 includes the grooves 55 into which the inner ribs 26 are to be fit. In this way, the warping of the butting portions 24 is prevented by ensuring a projecting dimension of the inner ribs 26.

The female connector F includes the housing 10 to be fit into the receptacle 81 of the male connector M, and the front retainer 50 to be mounted into the front part of the housing 10. The housing 10 includes the terminal accommodating portion 12 configured to accommodate the female terminal fittings 11. Substantially flat plate-shaped butting portions 24 extend forward from the outer periphery of the terminal accommodating portion 12 and are configured to butt against the back surface of the receptacle 81 when the housing 10 is fit into the receptacle 81. The front retainer 50 includes the cover 51 configured to cover the front end of the terminal accommodating portion 12 by being disposed along the inner surfaces of the butting portions 24. The formation range of the butting portions 24 is smaller than that of the cover 51 in the length direction of the butting portions 24 in a front view. Thus, the butting portions 24 are not likely to warp during molding, and the clearances S between the end parts of the butting portions 24 and the cover 51 are not likely to expand. This dimensional control makes it difficult for the receptacle 81 to enter the clearances S between the butting portions 24 and the cover 51. Thus, stress is less likely to concentrate on and break the butting portions 24 by the entrance of the receptacle 81 into the clearances S when the female connector F is connected to the male connector.

The housing 10 includes the outer ribs 27 projecting toward the side opposite to the cover 51 from the butting portions 24 and extending in the front-rear direction. Since warping during the molding of the butting portions 24 can be suppressed in this way, the expansion of the opening parts on the both ends of the clearances S between the end parts of the butting portions 24 and the cover 51 in a front view can be suppressed more reliably.

The front ends of the outer ribs 27 are aligned with those of the butting portions 24 in the front-rear direction. If the butting portion 24 is thin, a testing tool is not stabilized by being inclined in the thickness direction of the butting portion 24 or slipping even if an attempt is made to measure the position in the front-rear direction by pressing the testing tool against the front end of the butting portion 24. In this respect, according to the invention, the testing tool can be pressed reliably against the front end of the butting portion 24 by being pressed against an intersecting part of the butting portion 24 and the outer rib 27. Accordingly, the position of the front end of the butting portion 24 in the front-rear direction can be precisely grasped, and a forward projecting dimension of the front retainer 50 from the front end of the butting portion 24 can be measured. Further, the outer ribs 27 are provided in the laterally central part. In pressing the testing tool against the front end of the butting portion 24, it is also considered to press the testing tool against an intersecting part of the erroneous connection preventing rib 29 provided on one lateral one and the butting portion 24, but the position of the erroneous connection preventing rib 29 differs depending on the type of the connector. Thus, the pressing position varies depending on the type of the connector. In contrast, since the outer ribs 27 are provided in the laterally central part in the female connector F, the pressing position remains unchanged regardless of the type of the connector.

The front retainer 50 includes the intrusion preventing portions 54 projecting from the cover 51 to close the opening parts on the both end parts of the clearances S formed between the cover 51 and the butting portions 24 in a front view. Since the entrances to the clearances S between the butting portions 24 and the cover 51 are closed by the intrusion preventing portions 54 in this way, the entrance of the receptacle 81 into the clearances S can be prevented. Thus, stress is less likely to concentrate on and break the butting portions 24 by the entrance of the receptacle 81 into the clearances S.

The housing 10 includes the inner ribs 26 projecting toward the cover 51 from the butting portions 24 and extending in the front-rear direction. Since warping during the molding of the butting portions 24 can be suppressed in this way, the expansion of the opening parts on the ends of the clearances S between the end parts of the butting portions 24 and the cover 51 in a front view can be more reliably suppressed.

The connector device D of this embodiment includes the female connector F and the male connector M. The female connector F includes the lock arm 30 and the male connector M includes the lock receiving portion 83 to be locked to the lock arm 30. The outer ribs 27 of the female connector F guide the lock arm 30 in a direction to be locked to the lock receiving portion 83. In this way, the outer ribs 27 of the female connector F can also be utilized as guides for guiding the female connector F in a direction to be locked to the male connector M.

The lock arm 30 includes the cantilevered resilient locking piece using the outer ribs 27 as supports. Thus, a form for the female connector F can be simplified in shape as compared to the case where a support of the lock arm 30 and the outer ribs 27 are separated. Thus, resin satisfactorily spreads and a molding failure is unlikely to occur.

The invention is not limited to the above described embodiment. For example, the following embodiments also are included in the scope of the invention.

In the above embodiment, the front member is the front retainer. However, any member other than the front retainer may be used if this member can cover the front end of the terminal accommodating portion. For example, a front mask may be used.

In the above embodiment, the butting portions are provided at two upper and lower positions of the housing. However, butting portions may be provided on left and right sides instead of upper and lower sides or one butting portion may be provided only at one position.

LIST OF REFERENCE SIGNS

D . . . connector device
F . . . female connector (connector)
M . . . male connector (mating connector)
10 . . . housing
11 . . . female terminal fitting (terminal fitting)
12 . . . terminal accommodating portion
24 . . . butting portion
26 . . . inner rib
27 . . . outer rib
30 . . . lock arm (lock)
50 . . . front retainer (front member)
51 . . . cover
54 . . . intrusion preventing portion
55 . . . groove
81 . . . receptacle
83 . . . lock receiving portion

What is claimed is:

1. A connector, comprising:

a housing to be fit into a receptacle of a mating connector; and a front member to be mounted to a front part of the housing;

the housing including a terminal accommodating portion configured to accommodate terminal fittings and a butting portion substantially in the form of a flat plate extending forward from an outer peripheral edge of the terminal accommodating portion and configured to butt against a back surface of the receptacle when the housing is fit into the receptacle;

the front member including a cover configured to cover a front end of the terminal accommodating portion by being disposed along an inner side surface of the butting portion; and a formation range of the butting portion is smaller than that of the cover in a length direction of the butting portion in a front view.

2. The connector of claim 1, wherein the housing includes an outer rib projecting from the butting portion to a side opposite to the cover and extending in a front-rear direction.

3. The connector of claim 2, wherein:

a front end of the outer rib is aligned with that of the butting portion in a front-rear direction.

4. The connector of claim 3, wherein the front member includes intrusion preventing portions projecting from the cover to close both sides of a clearance formed between the cover and the butting portion in a front view.

5. The connector of claim 4, wherein the housing includes an inner rib projecting from the butting portion toward the cover and extending in a front-rear direction.

6. A connector device, comprising:

the connector of claim 2; and a mating connector to be connected to the connector;

the connector including a lock;

the mating connector including a lock receiving portion to be locked to the lock; and the outer rib of the connector guiding the lock in a direction to be locked to the lock receiving portion of the mating connector.

7. The connector device of claim 6, wherein the lock of the connector includes a cantilevered resilient locking piece using the outer rib as a support.

* * * * *